US008533870B2

(12) United States Patent
Barth et al.

(10) Patent No.: US 8,533,870 B2
(45) Date of Patent: Sep. 17, 2013

(54) PROTECTIVE HELMET HAVING A HARD INNER CAP AND A SHOCK-ABSORBING INNER FITMENT

(75) Inventors: Uwe Barth, Braunschweig (DE); Erkan Serbest, Braunschweig (DE)

(73) Assignee: Schuberth GmbH, Magdeburg (DE)

( * ) Notice: Subject to any disclaimer, the term of this patent is extended or adjusted under 35 U.S.C. 154(b) by 385 days.

(21) Appl. No.: 12/868,139

(22) Filed: Aug. 25, 2010

(65) Prior Publication Data

US 2011/0047678 A1 Mar. 3, 2011

(30) Foreign Application Priority Data

Aug. 27, 2009 (DE) ..... 10 2009 038 764

(51) Int. Cl.
*A42B 3/00* (2006.01)

(52) U.S. Cl.
USPC ..... 2/411; 2/6.6

(58) Field of Classification Search
USPC ..... 2/411, 414, 423, 171.3, 425, 6.1, 2/6.6, 410, 420, 421, 422, 9, 15, 10, 181.8, 2/413, 417, 418, 209.13; 24/458; 411/338
See application file for complete search history.

(56) References Cited

U.S. PATENT DOCUMENTS 5,068,922 A * 12/1991 Zahn ..... 2/6.8

FOREIGN PATENT DOCUMENTS

| | | |
|---|---|---|
| DE | 43 36 665 | 5/1995 |
| DE | 196 21 004 | 11/1997 |
| EP | 0 423 379 | 4/1991 |

* cited by examiner

*Primary Examiner* — Danny Worrell
*Assistant Examiner* — Khaled Annis
(74) *Attorney, Agent, or Firm* — Whitham Curtis Christofferson & Cook, PC

(57) ABSTRACT

A protective helmet has a helmet cap and a shock-absorbing inner fitment in the form of a grille-like basket. The basket includes bosses pointing to the inner wall of the helmet cap exercising a shock-absorbing function based on their plastic deformation under an impact. The basket may be fastened to the helmet cap with a shock-absorbing effect directly at the fastening point, by providing a fastening boss for the fastening of the basket to the helmet cap. The fastening boss includes an end face having a through opening for firm contact against the helmet cap. The helmet cap has a through opening aligned with the through opening in the end face. Correspondingly, bolt-shaped fastener abut against the outer side of the helmet cap and the inner side of the end face, and are connected such that the end face pressed against the inner wall of the helmet cap.

10 Claims, 4 Drawing Sheets

PROTECTIVE HELMET HAVING A HARD INNER CAP AND A SHOCK-ABSORBING INNER FITMENT

FIELD OF INVENTION

The invention relates to a protective helmet having a hard helmet cap and a shock-absorbing inner fitment in the form of a grille-like basket fastened to the hard helmet cap, which basket is provided with bosses which point to the inner wall of the helmet cap and which are configured to exercise a shock-absorbing function on the basis of their plastic deformation under the influence of an impact of predetermined minimum intensity onto the hard helmet cap.

BACKGROUND

A protective helmet of this type is known, for example, by virtue of EP 0 423 379 B1. The grille-like basket has a central part, from which strips are directed radially outwards. Adjacent radially outwardly directed strips are connected to one another by connecting pieces. This arrangement is manufactured in one piece as a flat-lying part by injection moulding. The curvature of the inner fitment, which curvature is matched to the shape of the helmet cap, derives from the fact that the ends of the radially outwardly directed strips are connected to a circumferential brace. Fastened in a normal manner to the brace is a circumferential head band, which encompasses the head of the helmet wearer roughly horizontally and is configured to bear against the head of the helmet wearer with a skin-friendly cushioning layer. The radially outwardly directed strips and the connecting strips of the basket are provided with bosses directed to the inner wall of the helmet cap, which bosses are configured, in particular, as hollow bosses which are open towards the inner wall of the helmet cap. The shock-absorbing effect of the inner fitment derives from a plastic deformation of the bosses in the event of a sufficiently strong impact upon the helmet cap, which impact can be triggered by different occurrences, in the case of a military protective helmet by firing, for example. The basket of the known protective helmet is fastened to the helmet cap at three points by screw joints. To this end, the basket is equipped with special boss-free lugs, which at their lower ends have through holes for the screwing to the helmet cap. The basket is here fastened such that at least some of the bosses are pressed against the inner wall of the helmet cap. The head of the helmet wearer here does not initially bear against the basket, but rather—generally with the aid of a hairnet attached to the headband—is held at a distance from the basket. Only if there is a strong impact on the helmet cap can the basket touch the head of the helmet wearer with the strips, so that the shock-absorbing effect herewith sets in by dint of an energy-consuming deformation of the material of the bosses. The grille-like basket provided with large apertures ensures good ventilation of the head of the helmet wearer when the helmet is worn, so that an inner fitment of this type, in particular for military protective helmets, has proved successful in numerous applications.

SUMMARY

The object of the present invention is to further improve a protective helmet of this type.

For the achievement of this object, according to the invention a protective helmet of the said type is characterized in that, for the fastening of the basket to the helmet cap, a hollow configured fastening boss of the basket is provided with an end face, having a through opening, for firm contact against the helmet cap, in that the helmet cap has a through opening aligned with the through opening in the end face, and in that bolt-shaped fastening means abut against the outer side of the helmet cap and against that inner side of the end face which is facing away from the helmet cap and are connected to one another in such a way that the end face is pressed against the inner wall of the helmet cap.

The present invention is based on the recognition that, in the known embodiment, the grille-like basket forming the inner fitment has no shock-absorbing bosses in the region of the fastening lugs, so that in this region, due to the design, no shock-absorbing effect can be realized. In contrast, the invention provides a fastening of the basket forming the inner fitment with the aid of a shock-absorbing boss, in that a hollow boss provided with an end face that closes off the boss is provided with a through opening through which the basket can be connected to the helmet cap by the fastening boss in the customary manner, a screw or rivet joint being expedient. According to the invention, the fastening of the basket—as in the previously known embodiment—can be effected at three points, namely at two points in the front side region of the helmet on each side and a central fastening point in the neck region. According to the invention, no boss-free fastening lugs have to be provided, but rather the fastening is effected by a boss of the bossed basket itself, which boss is configured as a fastening boss. Hence, even in the region of the fastening points, shock-absorbing bosses can be provided in any chosen number, with one shock-absorbing boss being realized in the fastening point itself.

In this case, it is readily possible that the fastening boss does not bear directly against the inner wall of the helmet cap, but rather via a material piece belonging to a helmet function element, so that helmet function elements can be held at one of more of the fastening points at the same time. In particular, the fastening of a chin strap and of a neck strap at the three fastening points which are preferably provided is a possibility.

If a screw joint is used, it is expedient to realize this such that it is bullet-proof, so that the bullet-proofing effect of the helmet cap is not negated by an unsuitable screw joint if a projectile strikes the screw. For screw joints of this type, it has thus proved successful to screw a headed screw sleeve and a headed screw bolt one into the other.

Alternatively it is possible to provide a rivet joint between the basket and the helmet cap.

The other bosses of the basket, which do not serve as fastening bosses, can likewise be configured, in a manner which is known per se, as hollow bosses. For the shock-absorbing effect of the bosses, it has proved successful to configure these such that they are open towards the helmet cap, i.e. to provide them with no terminating end wall.

It is preferred to perform the fastening of the basket forming the inner fitment solely via hollow fastening bosses. However, it is also possible to combine the fastening of the basket via hollow fastening bosses with another type of fastening, if this appears sensible for a specific application.

In an advantageous embodiment of the invention, at least one of the through openings in the basket is configured as a vertically orientated long hole. It is thereby possible to adjust the basket in the helmet shell and to pretension the bosses for contact against the inner wall of the helmet cap. If all through openings are configured as long holes of this type, then for this adjustment facility the basket in its entirety can be twisted somewhat relative to the helmet cap in order thus to establish the optimal contact against the helmet cap. In this case also, the fastening of the basket by means of three fastening bosses is preferred.

DESCRIPTION OF THE DRAWINGS

The invention shall be described in greater detail below with reference to an illustrative embodiment represented in the drawing, in which.

DETAILED DESCRIPTION

Figure 1:
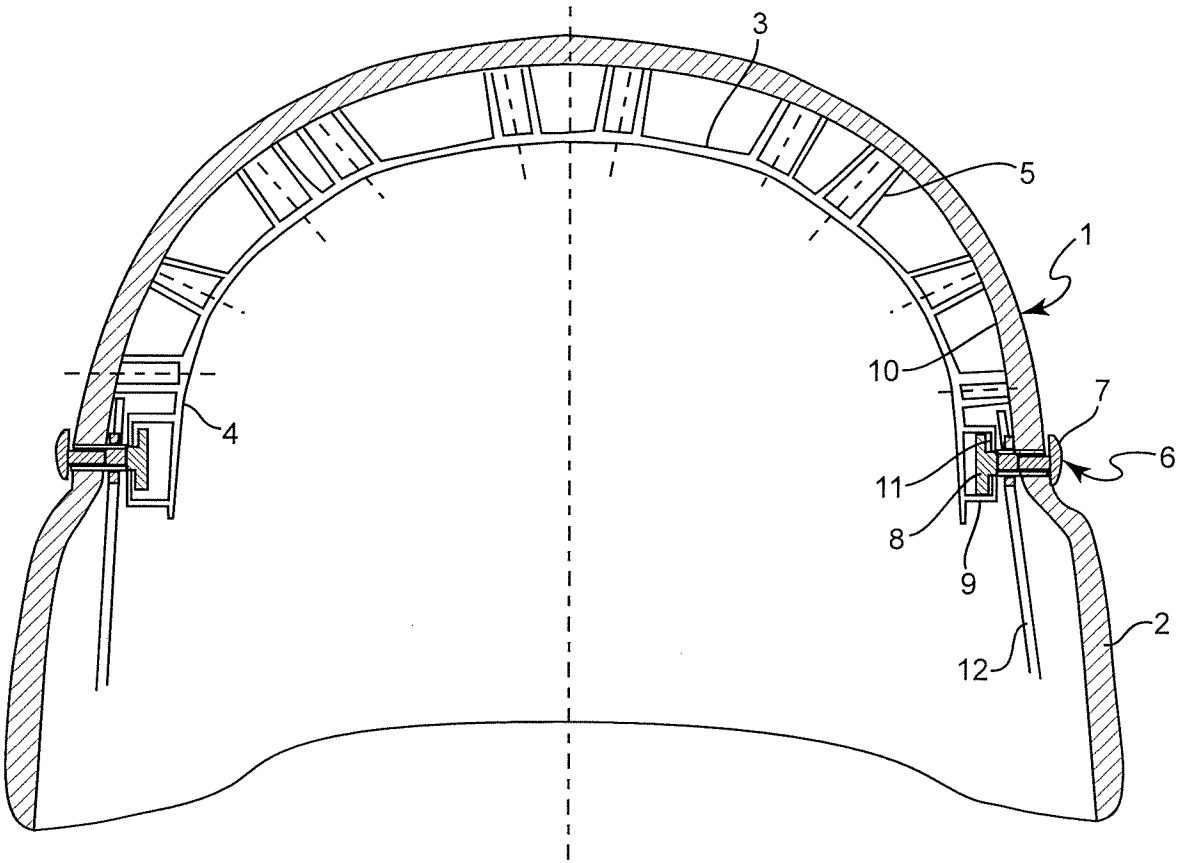
FIG. 1 shows a schematic representation of a vertical section through a protective helmet according to the invention.

FIG. 1 illustrates in section through the frontal plane a hard helmet cap 1, which in known manner has bulges 2 in the ear region of the helmet wearer. In the case of a military protective helmet, the helmet cap 1 consists of a multiplicity of fibre-reinforced plastics layers of a thermosetting plastic, which are jointly hardened under temperature and pressure to form a unitary helmet cap 1. The hard helmet cap 1 protects the head of the helmet wearer from objects which penetrate into the head region. In the case of a military protective helmet, the protection from fired projectiles is particularly important.

The further function of the protective helmet consists in protecting the head from shock loads which can be provoked by a variety of causes—including by firing. The shock-absorbing effect which is necessary for this cannot be produced by the hard helmet cap 1. A basket 3 is therefore fastened as a shock-absorbing inner fitment to the helmet cap 1. The basket 3 consists of radially running narrow bands, which are connected to one another by bands forming transverse webs. At the ends of the radially running bands, these are connected to one another by a circumferential brace 4. This connection to the brace also produces the curved shape of the basket 3, which latter, without the brace 4, can be manufactured as a one-piece flat-lying part. Both on the bands and on the brace 4 of the basket 3 are found bosses 5 directed to the helmet shell 1, which bosses are preferably configured as hollow cone portions which are open in the direction of the helmet shell 1 and are cylindrical or taper somewhat in conical fashion.

FIG. 1 illustrates that the fastening of the basket 3 to the helmet shell 1 is served by a screw joint 6, which has a screw head 7 on the outer side of the helmet cap and a screw head 8 inside a hollow-configured fastening boss 9. The fastening boss 9 is closed off to the inner wall 10 of the helmet cap 1 with an end face 11, which is borne against by the screw head 8.

In the illustrative embodiment represented in FIG. 1, the fastening boss 9 is configured with a lesser height than the adjacent further bosses 5 which bear directly against the inner wall of the helmet cap 1. The end face 11 is pulled by the screw joint 6 via a material piece 12 against the inner wall 10 of the helmet cap 1, so that the screw joint at the same time serves as fastening means for a function part of the protective helmet, which function part is connected to the material piece 12. In this case, the material piece 12 is connected to a chin/neck strap arrangement, which is thus fixed, at two fastening points formed by the screw joints 6, in both side regions of the protective helmet, as well as, at a third fastening point, formed by a screw joint 6, in the neck region of the protective helmet.

Figure 2:
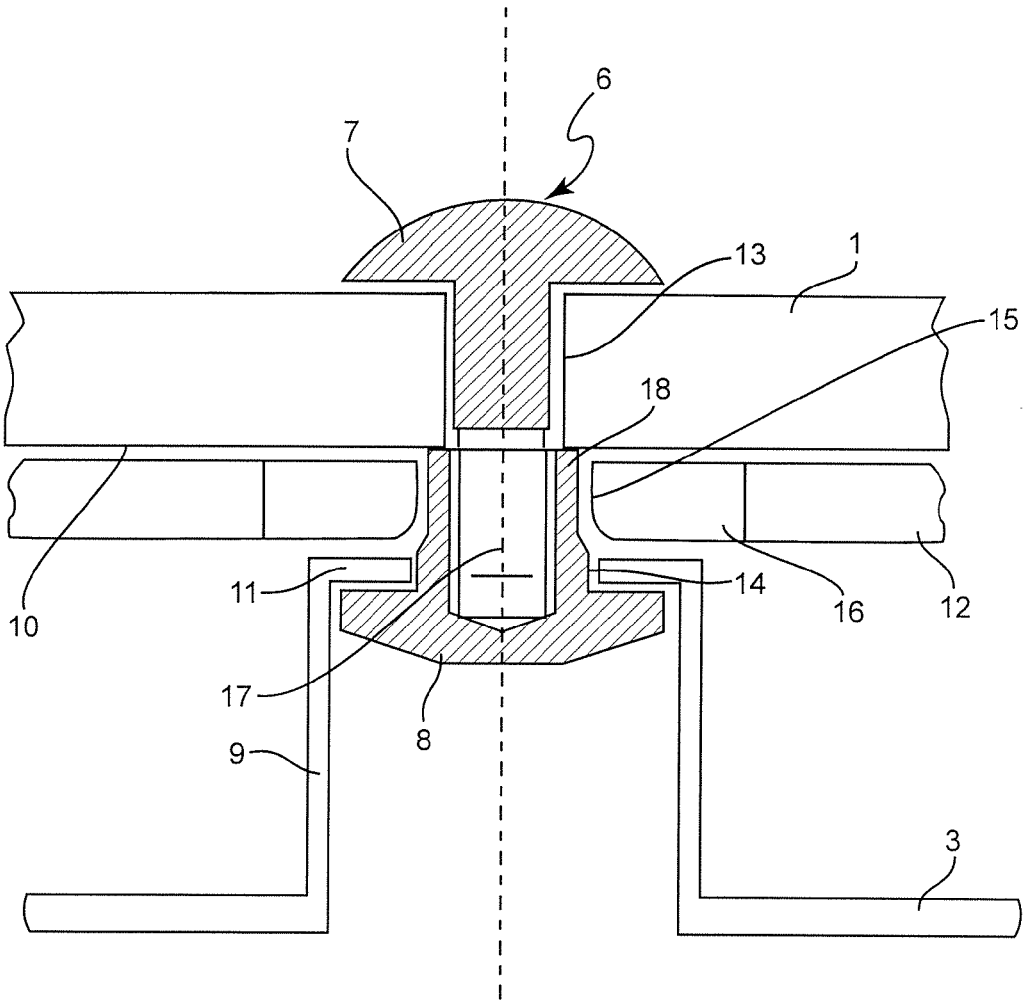
FIG. 2 shows an enlarged detailed representation of an inventive connection of the shock-absorbing helmet to the helmet cap.

FIG. 2 shows in an enlarged detailed representation the configuration of the screw joint 6 for fastening of the basket 3 to the helmet shell 1. The helmet shell has a through opening 13, which is aligned with a through opening 14 in the end face 11 closing off the fastening boss 9. Between the end face 11 and the inner wall 10 of the helmet is inserted a material piece 12 in the form of a fastening belt. The material piece is provided with a through opening 15, which is realized in an annular rivet 16 which closes off the belt in the direction of the through opening 15. The screw joint 6 is configured in two parts and consists of a screw bolt 17 integrally connected to the screw head 7, and a screw sleeve 18 integrally connected to the screw head 8 and serving as a nut. Through the screwing of the screw bolt 17 into the screw sleeve 18, the fastening boss 9 is pulled via the material piece 12 or the annular rivet 16 against the inner wall 10 of the helmet cap 1 and thereby fastened to the helmet cap 1. The screw head 7 can here be configured in any suitable form, i.e. for example a slot for a screwdriver, a hexagon socket, outer key faces, etc., as long as the required properties are ensured, for example, sufficient bullet-proofness for a military protective helmet. The selection of the material for the screw head 7 and the screw bolt 17 shall be made correspondingly.

Figure 3:
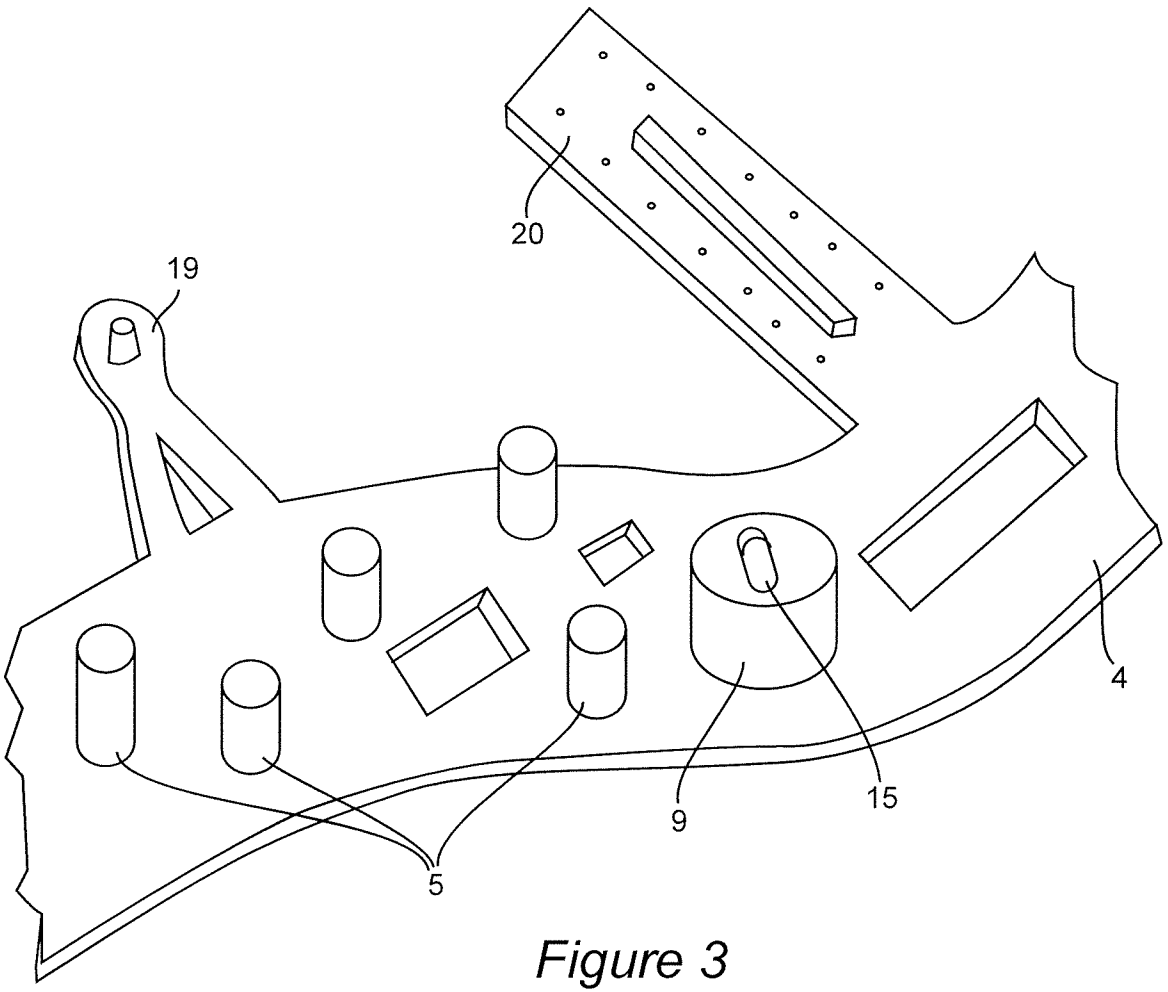
FIG. 3 shows a view of a circumferential brace having a fastening boss and further bosses directed to the helmet cap.

FIG. 3 shows the arrangement of the fastening boss 9 on the brace 4 of the basket 3. The brace 4 is provided with fastening lugs 19, 20, to which the ends of the radially outward running bands can be fastened for formation of the basket 3. Represented on the brace 4 are bosses 5, the height of which is greater than the height of the fastening boss 9, since the latter is provided for the simultaneous fastening of a chin/neck strap and thus has a height which is inferior by the thickness of the material piece 12 or of the annular rivet 16.

Figure 4B:
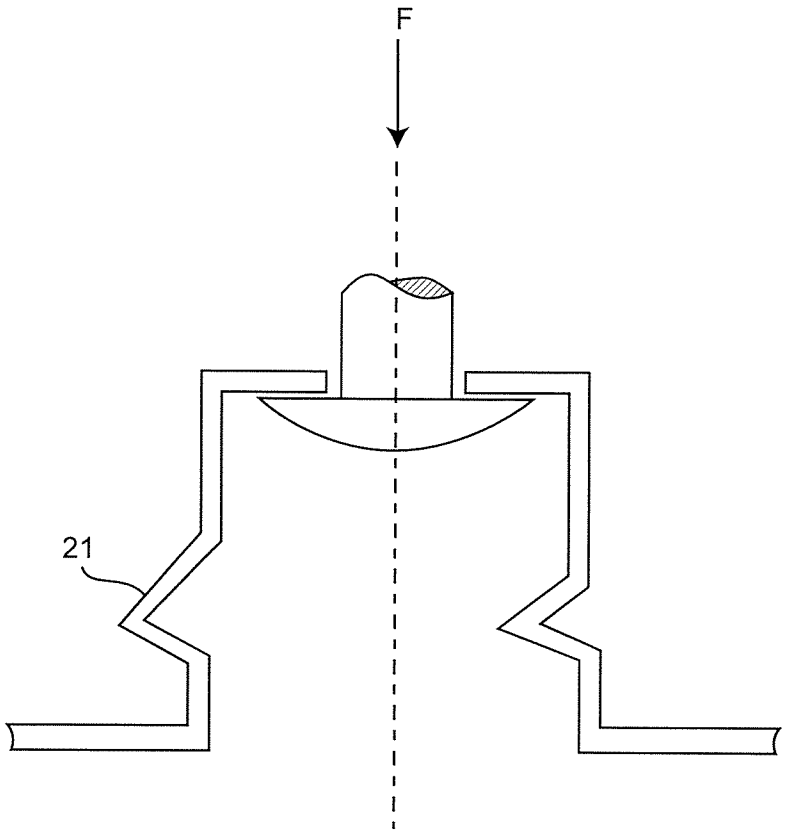
FIG. 4 shows a schematic representation of a fastening boss in the unloaded state and in an impact-loaded state, in which the shock-absorbing property of the fastening boss takes effect.
Figure 4A:
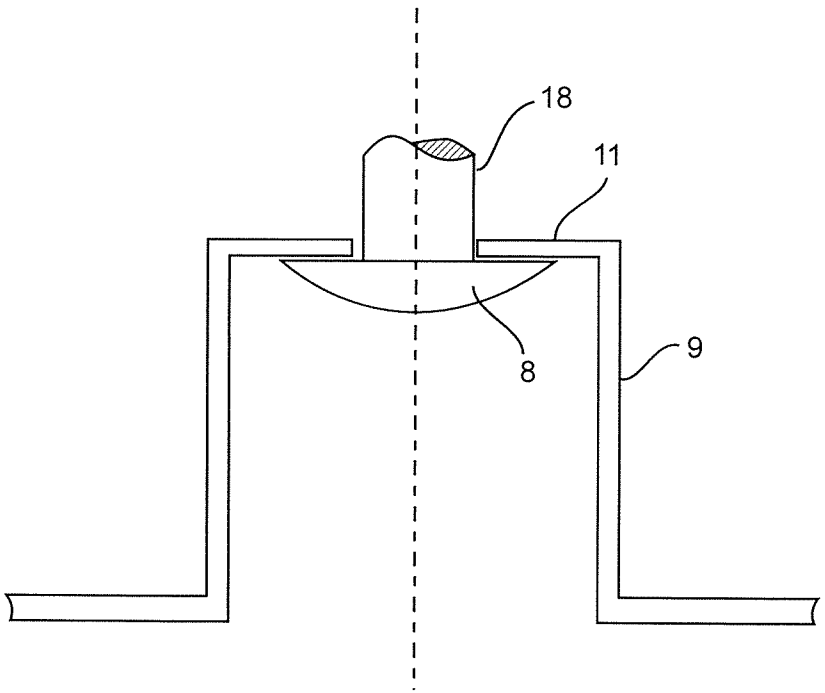

FIG. 4 shows in schematic representation the fastening boss in the initial state (FIG. 4*a*) and in its shock-absorbing function in the impact-loaded state (FIG. 4*b*). The material of the fastening boss 9 is chosen such that, in the event of a higher force application (arrow F in FIG. 4*b*), a deformation in the casing wall of the cylindrical fastening boss 9 is produced, whereby energy is absorbed and the shock effect upon the head of the helmet wearer is reduced. The deformation 21 in the casing wall of the fastening boss 9, represented schematically in FIG. 4*b*, shows just one example of a possible deformation. It is also possible for the deformation 21 to be made circumferentially outwards or circumferentially inwards. The deformation, as it is represented in FIG. 4*b*, can be attributable to an oblique effect of the impact on the fastening boss 9.

The type of deformation of the fastening boss 9 is immaterial, however, as long as a sufficient absorption of the impact energy occurs. According to the invention, this is possible also at the fastening points, since these, as a result of the fastening bosses 9, themselves contribute to the shock absorption.

The invention claimed is:

1. A protective helmet comprising:

a hard helmet cap;

a shock absorbing inner arrangement having:

a grille-like basket fastened to the hard helmet cap; and bosses directly attached to the grill-like basket, said bosses pointing to an inner wall of the hard helmet cap, wherein said bosses are configured so as to exercise a shock absorbing effect due to their plastic deformation under an influence of an impact of a predetermined minimum intensity onto the hard helmet cap;

a hollow cylindrical fastening boss of the grill-like basket is pressed against the hard helmet cap and is provided with an end face having an end face through opening;

a boss wall having a circumferentially inwardly extending wall from the grill-like basket;

a helmet cap through opening of the hard helmet cap is aligned with the end face through opening; and bolt-shaped fasteners abut the outer side of the hard helmet cap and an inner side of the end face facing away from the hard helmet cap, said bolt-shaped fasteners connected to one another so that the end face is pressed against the inner wall of the hard helmet cap, wherein the hollow cylindrical fastening boss is designed to absorb shocks due to a plastic deformation of the boss wall under the influence of the impact of the predetermined minimum intensity onto the hard helmet cap.

2. The protective helmet according to claim 1 further comprising:

a material piece belonging to a helmet function element of an upper portion of a chin strap or a neck strap is positioned or positionable between the end face of the hollow cylindrical fastening boss and the inner wall of the hard helmet cap.

3. The protective helmet according to claim 1, wherein the bolt-shaped fasteners include a screw joint.

4. the protective helmet according to claim 1, wherein the bolt-shaped fasteners include a screw sleeve with a screw head and a screw bolt with a screw head.

5. The protective helmet according to claim 1, wherein the bolt-shaped fasteners include a rivet joint.

6. The protective helmet according to claim 1, wherein the bosses of the grill-like basket are hollow.

7. The protective helmet according to claim 6, wherein the bosses of the grill-like basket are designed to open towards the inner wall of the hard helmet cap.

8. the protective helmet according to claim 1, wherein fastening of the grill-like basket is performed solely by a plurality of fastening bosses.

9. The protective helmet according to claim 8, wherein the plurality of fastening bosses is three fastening bosses.

10. The protective helmet according to claim 1, wherein at least one of the end face through opening and the helmet cap through opening extends in a vertical direction and is designed as a long hole.

* * * * *